United States Patent [19]

Arsac et al.

[11] 4,374,893

[45] Feb. 22, 1983

[54] TEXTILES WITH IMPROVED CONDUCTING PROPERTIES AND PROCESSES FOR THEIR MANUFACTURE

[75] Inventors: André Arsac, Vernaison; Michel Ducarre, Sainte-Foy-les-Lyon; Jean Grosbois, L'Isle Adam; Thomas Nener, Charville, all of France

[73] Assignee: Rhone-Poulenc-Textile, Paris, France

[21] Appl. No.: 277,607

[22] Filed: Jun. 26, 1981

[30] Foreign Application Priority Data

Jun. 26, 1980 [FR] France ..... 80 14286

[51] Int. Cl.[3] ..... D04B 1/00; B05D 5/12

[52] U.S. Cl. ..... 428/263; 427/126.1; 427/304; 427/322; 427/430.1; 428/389

[58] Field of Search ..... 428/263, 389; 427/125, 427/126.1, 304, 322, 430.1

[56] References Cited

U.S. PATENT DOCUMENTS

| | | | |
|---|---|---|---|
| 2,983,286 | 5/1961 | Greenwalt et al. . | |
| 3,663,242 | 5/1972 | Gulla | 428/263 |
| 3,666,550 | 5/1972 | Okuhashi et al. | 428/263 |
| 3,940,533 | 2/1976 | Arsac | 428/389 |
| 3,965,283 | 6/1976 | Moore | 428/389 |
| 3,983,286 | 9/1976 | Arsac | 428/389 |
| 4,201,825 | 5/1980 | Ebneth | 428/263 |
| 4,330,347 | 5/1982 | Hirayama et al. | 428/389 |

OTHER PUBLICATIONS

Japanese Journal of Applied Physics, vol. 12, Aug. 1973, K. Okamoto et al., pp. 1130–1138.

Japanese Journal of Applied Physics, vol. 16, Mar. 1977, N. Nimura et al., pp. 403–411.

*Primary Examiner*—William J. Van Balen

*Attorney, Agent, or Firm*—Stevens, Davis, Miller & Mosher

[57] ABSTRACT

Textiles, preferably yarns and fibers, based on synthetic polymers, with permanent conducting properties, which possess, on the surface, a uniform continuous layer consisting of at least 3% of copper sulphide, the composition of which is such that the atomic ratio Cu/S is between 1.5 and 2, and preferably more than 1.7, and of which the ratio $R/R_o$ is between 1 and 10, R being the electrical resistance after treatment for 400 hours at 60° C. and at a humidity of 70%, and $R_o$ being the initial resistance of the treated textile. The synthetic polymer is based on polyamide or polyester, or is an aromatic polyamide or a polyamide-imide. Processes for the manufacture of these textiles and textile articles with permanent conducting properties, such as floor/wall coverings, containing between 0.01 and 5% of the treated textiles, are also disclosed.

13 Claims, 1 Drawing Figure

TEXTILES WITH IMPROVED CONDUCTING PROPERTIES AND PROCESSES FOR THEIR MANUFACTURE

The present application relates to textiles with improved conducting properties and to processes for their manufacture.

To eliminate the phenomena of static electricity in textile articles such as floor or wall coverings and clothing, a variable amount of electrically conducting yarns or fibers is incorporated into naturally insulating yarns or fibers used for the manufacture of these articles.

U.S. Pat. No. 3,940,533 claims a process for fixing metal compounds to textile articles made of synthetic polymers, in accordance with which the said articles are subjected to the action of hydrogen sulphide under pressure or to that of an aqueous solution of a sulphur compound containing a reactive sulphur atom, and then to the action of an aqueous solution of a metal salt, preferably a copper salt.

U.S. Pat. No. 3,983,286 to the above-mentioned French patent provides an improvement to the process claimed in the main application, in accordance with which the cupric salt treatment is carried out in the presence of a swelling agent for the material treated, preferably a polyphenol.

The process gave good results in industry; however, it was found that, in a moist atmosphere and in the presence of air, the yarns and fibers treated did not prove entirely satisfactory during storage or use; their electrical resistance increases with time until the products treated no longer perform their function as conductors. Furthermore, during their conversion, the yarns and fibers treated are subjected to mechanical stresses and frictional forces, which can lead to breaks on the surface of the metal salt deposit. Other causes of the potential degradation of their conducting properties are the cleaning and washing treatments to which the finished articles containing these yarns and fibers are normally subjected.

To understand this degradation, the phenomenon which takes place during the treatment of the yarns and fibers with the metal salts, in accordance with the process claimed in the above-mentioned patents, has been studied. The chemical reaction of the hydrogen sulphide with the $Cu^{++}$ cations fixed to the textile forms a precipitate of copper sulphide, the composition of which varies between that of cupric sulphide, CuS, in which the atomic ratio (Cu/S)=1, and that of cuprous sulphide, $Cu_2S$, in which the atomic ratio (Cu/S)=2, the product treated having a color varying from green in the case of cupric sulphide to bronze or violet/claret-colored in the case of cuprous sulphide. By studying the nature of the composition of the copper sulphide layer and its change with time, it has been discovered that it is possible to obtain a treated textile exhibiting a high degree of permanency of the desired conducting properties.

The present invention relates to textiles, preferably yarns and fibers, based on synthetic polymers, with permanent conducting properties, characterised in that they possess, on the surface, a uniform continuous layer consisting of at least 3% of fixed copper sulphide, the composition of which is such that the atomic ratio Cu/S is between 1.5 and 2, and preferably more than 1.7, and of which the ratio $R/R_o$ is between 1 and 10, R being the electrical resistance after ageing for 400 hours in an atmosphere kept at a relative humidity of 70% and a temperature of 60° C., and $R_o$ being the initial resistance of the treated textile.

The present application also relates to a process for the manufacture of the above-defined textiles, preferably yarns and fibers, with improved conducting properties, characterised in that, after treatment with hydrogen sulphide and with a metal salt, optionally in the presence of a swelling agent, an after-treatment is carried out in the presence of at least one reducing agent.

The present application also relates to another process for the manufacture of the above-defined textiles, preferably yarns and fibers, with improved conducting properties, characterised in that, after treatment with hydrogen sulphide, a treatment with a metal salt and optionally with a swelling agent for the textile is carried out in the presence of at least one reducing agent and copper cations.

The synthetic textiles, preferably in the form of yarns and fibers, are made of a polymer based on polyamide, such as polyhexamethyleneadipamide, polyester, such as poly-(ethylene glycol) terephthalate, and aramides, such as polyamide-imide or aromatic polyamide; it is also possible to use copolymers and mixtures of polymers; the extruded textiles can be in the form of a two-component side-by-side or core-sheath structure.

By studying the ageing of the yarns and fibers treated by the processes of the abovementioned patents, it has been possible to observe that the products with good ageing behavior are those in which the atomic ratio (Cu/S) is closest to that of the cuprous sulphide structure, namely those in which the atomic ratio (Cu/S) is between 1.5 and 2, and preferably more than 1.7. The closer this ratio is to 2, the greater the observed increase in the ageing resistance and the greater the observed permanency of the conducting properties. This is surprising because it is known that cuprous sulphide is a poor conductor and, from the logical point of view, the closer the structure is to the cuprous sulphide structure, the less evident the conducting properties ought to be. However, if the oxidation of copper sulphide in the presence of air is observed, it is found that cupric sulphide, CuS, is much more readily oxidisable than cuprous sulphide, $Cu_2S$, and hence deteriorates more rapidly in respect of the conductivity.

In accordance with one of the processes claimed, an after-treatment is carried out in the presence of a reducing agent; ascorbic acid or hydrazine is preferably used. Ascorbic acid is preferably used in an amount of between 5 and 10 g/liter in an acid medium.

Hydrazine in the form of the hydrochloride or hydrate should preferably be used in the presence of cupric salts and in a basic medium, in order for the reducing action to be effective. Under these conditions, the anionic ions should be complexed in order to prevent the precipitation of copper hydroxide. To do this, tartaric acid is added, the pH is then adjusted to 9 with the aid of ammonia, and hydrazine hydrate is subsequently introduced. Good results are obtained under these conditions.

In accordance with the other process claimed, a reducing agent is added to the bath of metal salt and swelling agent. This agent must have a sufficient reduction potential to favor the formation of cuprous sulphide at the expense of cupric sulphide. It must not destabilise the cupric salt solution. Amongst the reducing agents, it is preferable to use between 1 and 20 g/liter of ascorbic acid in an acid medium with a pH of between 1 and 5, which can optionally be adjusted with sodium hydroxide used in an amount of 2 to 30 g/liter. As regards the swelling agent used to improve the penetration and the fixing of the copper salt to the treated textile, resorcinol or pyrocatechol is generally used. It has been discovered that triphenol (pyrogallol) can perform the dual function of swelling agent for the polyamide and of reducing agent for facilitating the formation of cuprous sulphide. Thus, some of the usual swelling agent (at least 5 g/liter) can be replaced by an equivalent amount of pyrogallol. The total amount of swelling agent must remain equal to at least 50 g/liter.

The different monitoring methods used are as follows:

Ageing Measurement

For the ageing measurement, or measurement of the change in the conducting properties with time, the following method is used: a roving of treated textile is adjusted to an average weight of 120±10 milligrams. The two ends of the roving are fixed to two lugs with the aid of a clip, so as to leave a usable length of 10 centimeters. Each lug is subsequently clamped to a frame, which is then mounted in a climatic chamber regulated at 60° C. and a relative humidity of 70%. The values of the electrical resistance of the roving are used to evaluate the change in the conducting properties with time. These measurements are carried out using direct current, with a DATA Precision 935 monitoring device. A contactor-and-pin system makes it possible to measure each roving installed in the climatic chamber. The initial resistance of the roving is $R_o$ ohms and is measured at ambient temperature. The different values of R at the instant T are then measured at a temperature of 60° C. and a relative humidity of 70%. Before measuring the initial resistance of the roving, $R_o$, and the different values of R, the roving treated in accordance with the process is subjected to the action of an aqueous solution of acetic acid, adjusted to pH=4 with dilute sodium hydroxide solution, liquor ratio: 1/30, treatment for one hour at the boil and then rinsing with distilled water and drying in a ventilated oven at 60° C. for one hour.

Measurement of the Ratio Cu/S

The measurement is carried out by an electrochemical method.

The determination of mixtures of cuprous and cupric sulphides by electrochemical methods has been described in the literature (M. C. BRAGE, M. LAMACHE and D. BAUER, Analusis, 1978, 6, 7, page 284).

The following procedure was used in the present application: an electrode is formed by winding a known weight of fiber (P=500 mg) around a graphite plate (60×30×10 mm) used to supply current.

Voltammetry graphs in a 0.1 N $HClO_4$ medium are plotted by means of a linear sweep of the potential from the potential of the electrode at zero current.

On a first sample of weight $P_A$, an anode sweep is carried out.

A peak appears, which corresponds to the electrochemical reaction:

$$Cu_2S \rightarrow Cu^{2+} + CuS + 2e^-$$

and of which the area $Q_{A1}$, expressed in coulombs, makes it posible to calculate:

$$Cu_2S = \frac{Q_{A1}}{2F} \times \frac{P_A}{100} \text{ mols per 100 g of fiber (or in \%).}$$

On a second aliquot of fiber of weight $P_C$, a cathode sweep is carried out. Two peaks appear, of areas $Q_{C1}$ and $Q_{C3}$, which correspond to the reactions:

$$Q_{C1}: CuS + \text{residual } Cu^{2+} + 2e^- \rightarrow Cu_2S$$

$$Q_{C3}: 2CuS + 2H^+ + 2e^- \rightarrow Cu_2S + H_2S$$

$$\text{with CuS} = \frac{1}{F}\left(\frac{Q_{C1}}{2} + Q_{C3}\right) \times \frac{P_C}{100} \text{ mols per 100 g}$$

(or in %), F is Faraday number.

The following empirical formula is deduced therefrom:

$$Cu_xS, \text{ in which } x = \frac{[CuS] + 2[Cu_2S]}{CuS + Cu_2S}$$

BRIEF DESCRIPTION OF THE DRAWING

The curves relating to the electrochemical analysis of a fiber will be found in the attached FIG. 1, which show the results of the measurements just described wherein $Q_{A1}$, $Q_{C1}$ and $Q_{C3}$ are as defined above.

MEASUREMENT OF THE ELECTRICAL RESISTANCE

Figure 1:
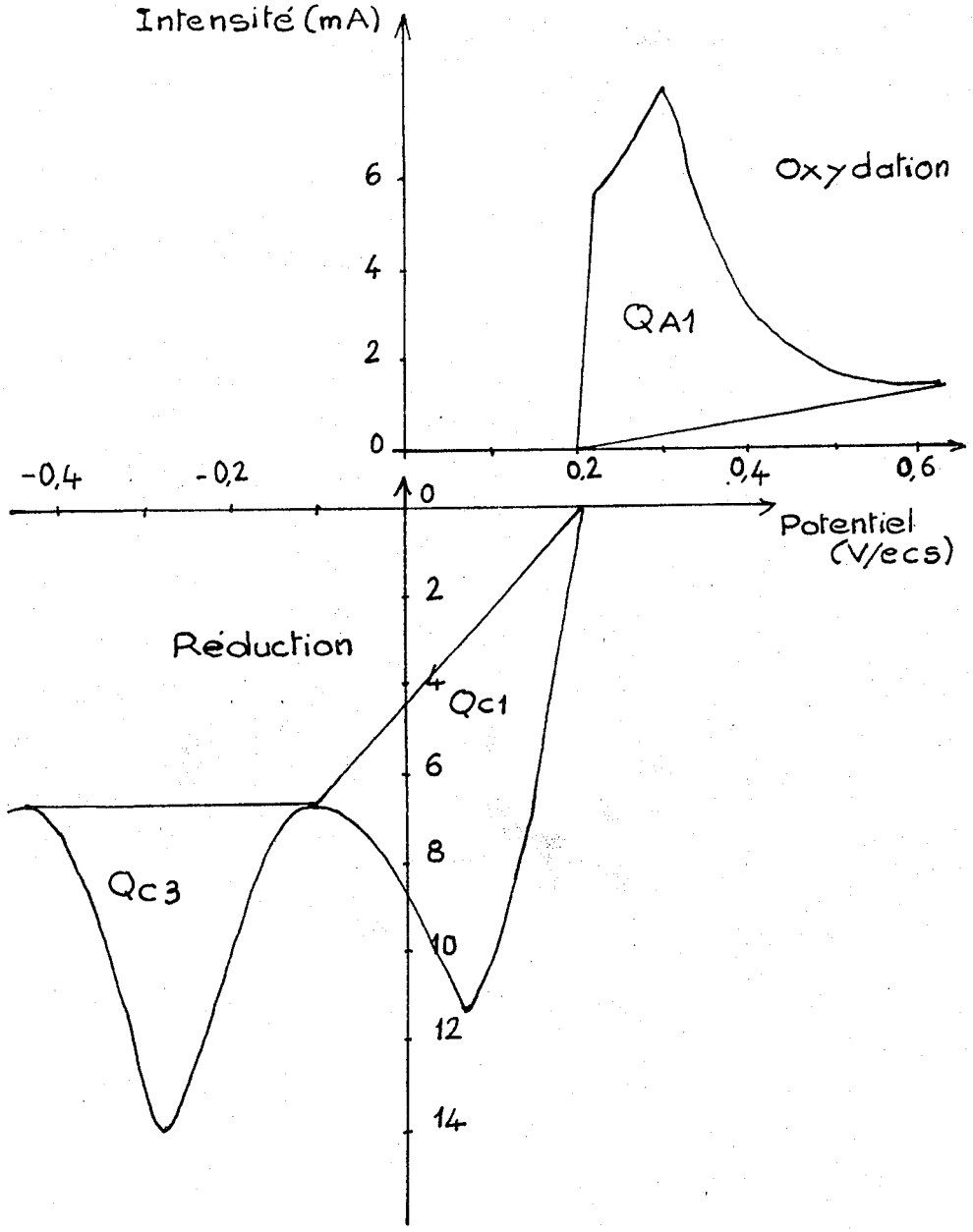

The measurement is carried out on untensioned fibers; to do this, a grounded insulated metal box of dimensions 30×8×8 centimeters is used, inside which a fixed terminal and a moving terminal are mounted, which are electrically insulated except for the connections with external equipment. The movable lug can rise and fall on a screw controlled by a variable-speed motor. For the measurement, the fibers are fixed bewteen the terminals under a tension of 1 g/tex. The result of the measurement is given as an average over 20 samples of each fiber; a vibrating electrometer (Industrial Vibron Electrometer Model 33 C and an Industrial Converter Unit B 33 C-2) is used, the applied voltage being 9.7 volts.

Resistance after Abrasion

The abrasion is measured with the aid of a device which makes it possible to rub the fibers on a stainless steel rod of 2 centimeters in diameter, the surface of which is treated with a satin finish (Tital 9). Rubbing is effected over a length of 13 centimeters of fibers at a rate of 43 passes per minute. The resistance is measured as above, after 1,000 rubbing cycles on the rod.

Blank Dyeing Treatment

The following test was used to treat the textile subjected to the former processes and to the processes of the present application. It is referred to as blank dyeing because it is carried out without using a dyestuff, the fixing of copper sulphide resulting in coloration of the textile. It makes it possible to test the stability of this coloration and hence the stability of the fixed copper salt and consequently of the maintenance of the conducting properties.

The textiles are treated in 180 ml of a liquid containing 0.64% g of 30% strength acetic acid, for 60 minutes at 130° C. The weight ratio of the textile to the liquid is 1 to 30. After treatment, the textile is cooled to 70° C. in the course of 40 minutes and is then subjected to four rinses, namely two in 1 liter of cold water containing 2 g of sodium hydroxide, and two in pure water. Each rinse lasts 10 minutes. The textile is then squeezed in a centrifugal machine for 2 minutes. The chemical resistance of the textile, such as yarns or fibers, is then measured as described above.

Resistance after Treatment with Solvents

As the use of solvents for the dry cleaning of textiles can lead to a deterioration of their conducting properties, the resistance of the untensioned fibers is measured after immersion in each of the following three solvents: benzene, methanol and perchloroethylene, without agitation, for one week at ambient temperature.

Resistance after Domestic Washing

The method described in British Standard Specification No. 4,923, 1973, is employed, using a 0.05% strength aqueous solution of sodium dioctylsulfosuccinate as the washing liquid, a washing temperature of 40° C. and a duration of 15 minutes, this being followed by three 3-minute rinses in clear water at ambient temperature, and light drying.

The resistance is then measured on untensioned fibers, as indicated above.

The textiles treated in this way, according to the present application, exhibit an improved stability to ageing, domestic washing and dry cleaning. They can be used by themselves or in a blend with untreated textiles.

They are preferably used in the form of treated continuous yarns or treated fibers, blended with untreated yarns, spun yarns or fibers in a proportion of 0.01 to 5%, in order to obtain results compatible with the desired technical and economic aspects; a higher percentage may obviously be employed, but to no particular advantage. The woven, knitted or non-woven textile articles containing the treated products of the present application are mainly floor or wall coverings, articles of clothing, furniture or coachwork, and, as a general rule, all textile articles in which conducting properties are desired.

The following examples illustrate still more fully the present invention but without limiting it.

EXAMPLE 1

Manufacture of a control fiber in accordance with the process described in U.S. Pat. No. 3,940,533.

A tow of continuous filaments made of polyhexamethyleneadipamide, having a gauge per strand of 6.7 dtex, is placed in a reactor fed with hydrogen sulphide under an absolute pressure of 3.8 bars and at a temperature of 20° C. This pressure is kept at 3.8 bars by continuously introducing gas, some of which is gradually absorbed by the polyamide fiber. After 45 minutes, the fibrous material is saturated with hydrogen sulphide. It is then impregnated with an aqueous solution containing 100 g/liter of crystalline copper sulphate and 55 g/liter of meta-diphenol (resorcinol), at a temperature of 55° C. After impregnation for 30 minutes, the fiber is washed with hot water at 70° C. and with an aqueous solution, at 70° C., containing 2 g/liter of sodium hydroxide. Finally, it is washed with pure water at a temperature of 70° C. This gives a fiber which is covered on the periphery with a copper sulphide layer. The fiber possesses the following characteristics, measured in accordance with the methods described above:

Color: green

Chemical composition of the layer: proportion of cuprous sulphide, $Cu_2S=2\%$, proportion of cupric sulphide, CuS: 1.34%, which corresponds to:

proportion of copper: 2.5% proportion of sulphur: 0.85% that is to say 3.35% of fixed copper sulphide, atomic ratio (Cu/S)=1.46

Mechanical properties:

tensile strength: 4 g/dtex elongation at break: 30–35%

Electrical properties:

chemical resistance $R=8.5\times10^4$ ohms/cm

Study of the change in the conducting properties during the various treatments:

The electrical resistance measurements are carried out on 20 samples. Either the average value obtained is given (in the case where the treatment has had little effect), or the minimum and maximum values are given, in the case where the results are widely scattered:

ageing, $(R/R_o)=4{,}000$ after 200 hours, $\infty$ after 400 hours after dyeing:

$5.2\times10^5$ ohms/cm $<R<1.8\times10^{11}$ ohms/cm after abrasion:

$7.5\times10^5$ ohms/cm $<R<10^{15}$ ohms/cm after treatment with solvents:

benzene: $R=4.9\times10^5$ ohms/cm methanol: $R=5.7\times10^5$ ohms/cm $<R<10^{15}$ ohms/cm perchloroethylene: $R=1.6\times10^5$ ohms/cm after domestic washing at 40° C.:

after 5 washes: $R=4\times10^5$ ohms/cm after 10 washes: $R=6\times10^6$ ohms/cm

EXAMPLE 2

Treatment according to the present application:

The treated tow of Example 1, after washing and drying, is immersed in a bath containing: 5 g/liter of ascorbic acid and 5 g/liter of copper sulphate ($CuSO_4.5H_2O$), at a temperature of 20° C. After treatment for half an hour, the tow is rinsed with pure water and then dried at 60° C. It possesses the following characteristics:

Color: red-brown

Chemical composition:

proportion of copper: 3% proportion of sulphur: 0.84%, that is to say 3.84% of fixed copper sulphide, atomic ratio Cu/S=1.81

Mechanical properties:

identical to those of Example 1

Electrical properties:

resistance: $1.2\times10^5$ ohms/cm after ageing:

$(R/R_o)=1.7$ after 200 hours $(R/R_o)=2.6$ after 400 hours after blank dyeing:

$R=1.5\times10^5$ ohms/cm after abrasion:

$R=4.5\times10^5$ ohms/cm after treatment with solvents:

benzene: $R=2\times10^5$ ohms/cm methanol: $R=4.1\times10^5$ ohms/cm perchloroethylene: $R=6.1\times10^4$ ohms/cm after domestic washing at 40° C.:

after 5 washes: $R=3.2\times10^5$ ohms/cm
after 10 washes: $R=5\times10^5$ ohms/cm

EXAMPLE 3

Treatment in accordance with the process of the present application:

The polyamide tow of Example 1, after washing and drying, is immersed in an aqueous solution containing 12.5 g/liter of copper sulphate, 1.20 g/liter of tartaric acid and 4 g/liter of hydrazine. The pH of the bath is brought to 9/9.5 by adding ammonia. After treatment for 30 minutes, the tow is rinsed with warm water and dried at 60° C. It possesses the following characteristics:

Color: red-brown
Chemical composition:
proportion of copper: 2.80%
proportion of sulphur: 0.83%
that is to say 3.63% of fixed copper sulphide,
atomic ratio: (Cu/S)=1.70
Mechanical properties:
identical to those of Example 1
Electrical properties:
resistance: $8\times10^4$ ohms/cm
after ageing:
$(R/R_o)=1.7$ after 200 hours
$(R/R_o)=2.6$ after 400 hours
after blank dyeing:
$R=4.8\times10^5$ ohms/cm
after abrasion:
$R=4\times10^5$ ohms/cm
after treatment with solvents:
benzene: $R=2\times10^5$ ohms/cm
methanol: $R=4\times10^5$ ohms/cm
perchloroethylene: $R=6.7\times10^4$ ohms/cm
after domestic washing at 40° C.:
after 5 washes: $R=3.9\times10^5$ ohms/cm
after 10 washes: $R=5\times10^5$ ohms/cm

EXAMPLE 4

Treatment in accordance with the process of the present application.

The procedure of Example 1 is followed, but 5 g/liter of ascorbic acid and the equivalent amount of sodium hydroxide, in order to neutralise the ascorbic acid, are added to the aqueous sulphurizing bath containing the resorcinol and the copper sulphate. The pH of the sulphurizing bath is then equal to 2.6. As in Example 1, this bath is reacted at 55° C. with the fiber, impregnated with hydrogen sulphide. After rinsing, washing with aqueous sodium carbonate solution, rinsing and then drying, a product is obtained which has the following characteristics:

Color: violet
Chemical composition:
proportion of copper: 4.40%
proportion of sulphur: 1.27% that is to say 5.67% of fixed copper sulphide,
atomic ratio Cu/S=1.74
Mechanical properties:
identical to those of Example 1
Electrical properties:
resistance: $2\times10^5$ ohms/cm
after ageing:
$R/R_o=1.3$ after 200 hours
$R/R_o=1.7$ after 400 hours
after blank dyeing:
$R=4.6\times10^5$ ohms/cm
after abrasion:
$R=3.2\times10^5$ ohms/cm
after treatment with solvents:
benzene: $R=1.7\times10^5$ ohms/cm
methanol: $R=3.6\times10^5$ ohms/cm
perchloroethylene: $R=3\times10^5$ ohms/cm after domestic washing at 40° C.:
after 5 washes: $R=3.1\times10^5$ ohms/cm
after 10 washes: $R=4.6\times10^5$ ohms/cm

EXAMPLE 5

Treatment in accordane with the process of the present application.

The procedure of Example 1 is followed, but 10 g/liter of pyrogallol are added to the sulphurizing bath. The pH of the sulphurizing solution is 2.2. The tow is treated as in Example 1 and then washed, rinsed and dried. The characteristics which it possesses are as follows:

Color: violet
Chemical composition:
proportion of copper: 4.35%
proportion of sulphur: 1.22% that is to say 5.57% of fixed copper sulphide,
atomic ratio Cu/S=1.80
Mechanical properties: as in Example 1
Electrical properties:
chemical resistance: $1.3\times10^5$ ohms/cm
change in the electrical properties during the various treatments; the results are given as in Example 1:
after ageing:
$R/R_o=1$ after 200 hours
$R/R_9=1.2$ after 400 hours
after blank dyeing:
$R=4.5\times10^5$ ohms/cm
after abrasion:
$R=3\times10^5$ ohms/cm
after treatment with solvents:
benzene: $R=1.6\times10^5$ ohms/cm
methanol: $R=3.5\times10^5$ ohms/cm
perchloroethylene: $R=6.1\times10^4$ ohms/cm
after heat treatment at 130° C. for 24 hours:
$R=1.6\times10^5$ ohms/cm
after domestic washing at 40° C.:
after 5 washes: $R=3\times10^5$ ohms/cm
after 10 washes: $R=4.6\times10^5$ ohms/cm
All the strands are still conducting after 10 washes.

EXAMPLE 6

Treatment according to the present application.

Treatment is carried out as in Example 1, but the resorcinol (50 g/liter) in the sulphurizing bath is replaced by pyrogallol in the same amount of 50 g/liter. The pH of the sulphurizing bath is 3.3. After rinsing, washing and drying, the product obtained possesses the following characteristics:

Color: violet
Chemical composition:
proportion of copper: 4.34%
proportion of sulphur: 1.23%
that is to say 5.57% of fixed copper sulphide,
atomic ratio (Cu/S)=1.78
Mechanical properties: identical to those in Example 1
Electrical properties:
chemical resistance: $10^5$ ohms/cm
after ageing:
$R/R_o=0.75$ after 200 hours
$R/R_o=0.85$ after 400 hours after blank dyeing:
$R=4.4\times10^5$ ohms/cm
after abrasion:
$R=3\times10^5$ ohms/cm
after treatment with solvents:
benzene: $R=1.5\times10^5$ ohms/cm
methanol: $R=3.5\times10^5$ ohms/cm
perchloroethylene: $R=1\times10^5$ ohms/cm
after domestic washing at 40° C.:
after 5 washes: $R=3.1\times10^5$ ohms/cm
after 10 washes: $R=4.7\times10^5$ ohms/cm

EXAMPLE 7

Preparation of a control sample.

Fiber made of polyester prepared by the polycondensation of terephthalic acid and ethylene glycol, and having a gauge per strand of 5.5 dtex, is used as the textile substrate. The textile is treated as in Example 1, but the resorcinol is replaced by pyrocatechol (poorly reducing) at a concentration of 100 g/liter. The pH of the solution is 3. The product obtained possesses the following characteristics:

Color: bronze-green
Mechanical properties:
tensile strength: 8 g/dtex
elongation at break: 13%
Chemical composition of the layer:
proportion of copper: 2.60%
proportion of sulphur: 0.92%
that is to say 3.52% of fixed copper sulphide,
atomic ratio (Cu/S)=1.42
chemical resistance: $2\times10^4$ ohms/cm
after ageing:
$(R/R_o)=1.7$ after 400 hours
$(R/R_o)=4.1$ after 800 hours

EXAMPLE 8

Treatment according to the present application.

The same textile as in Example 7 is used, and the process is carried out under the same conditions, except that 10 g/liter of pyrogallol are added to the sulphurizing bath in order to increase the reducing power. The treated product possesses the following characteristics:

Color: bronze
Mechanical properties: identical to those in Example 7
Chemical constitution:
proportion of copper: 3.75%
proportion of sulphur: 1.01%
that is to say 4.76% of fixed copper sulphide,
atomic ratio Cu/S=1.87
chemical resistance: $1.9\times10^4$ ohms/cm
after ageing:
$R/R_o=1.02$ after 400 hours
$R/R_o=1.15$ after 800 hours

EXAMPLE 9

Preparation of the control.

A tow of continuous yarns of 4 dtex per strand, made of polyamide-imide with the trademark KERMEL (RHONE-POULENC-TEXTILE), is used, and this is treated by the process described in Example 1 and under the same treatment conditions as the fiber based on polyhexamethyleneadipamide. The treated product obtained possesses the following characteristics:

Color: deep blue
Mechanical properties:
tensile strength: 1.61 g/dtex
elongation at break: 43%
Chemical constitution:
proportion of copper: 4.03%
proportion of sulphur: 1.55%
that is to say 5.58% of fixed copper sulphide
atomic ratio Cu/S=1.31
Electrical properties:
chemical resistance: $1\times10^4$ ohms/cm
after ageing:
$(R/R_o)=60$ after 400 hours
$(R/R_o)=470$ after 800 hours

EXAMPLE 10

The same product and the same treatment process as in Example 9 are used, but 10 g/liter of pyrogallol are added to the sulphurizing bath. After complete treatment as in Example 1, the product obtained possesses the following characteristics:

Color: deep blue
Mechanical properties: identical to those of Example 9
Chemical constitution:
proportion of copper: 8.2%
proportion of sulphur: 2.34%
that is to say 10.54% of fixed copper sulphide,
atomic ratio Cu/S=1.76
Electrical properties:
chemical resistance: $2\times10^4$ ohms/cm
after ageing:
$(R/R_o)=1.4$ after 400 hours
$(R/R_o)=1.6$ after 800 hours

What is claimed is:

1. Textiles, preferably yarns and fibers, based on synthetic polymers, with permanent conducting properties, characterised in that they possess, on the surface, a uniform continuous layer consisting of at least 3% of copper sulphide, the composition of which is such that the atomic ratio (Cu/S) is between 1.5 and 2, and of which the ratio $(R/R_o)$ is between 1 and 10, R being the electrical resistance after treatment for 400 hours at 60° C. and a humidity of 70%, and $R_o$ being the initial resistance of the treated textile.

2. Textiles according to claim 1, characterised in that the synthetic polymer is based on polyamide.

3. Textiles according to claim 1, characterised in that the synthetic polymer is based on polyester.

4. Textiles according to claim 1, characterised in that the synthetic polymer is an aromatic polyamide.

5. Textiles according to claim 1, characterised in that the synthetic polymer is a polyamide-imide.

6. Process for the manufacture of the textiles as defined in claim 1, in accordance with which the said textiles are subjected to the action of hydrogen sulphide under pressure, and then to the action of an aqueous solution of a copper salt, optionally in the presence of a swelling agent, characterised in that an after-treatment is carried out in the presence of at least one reducing agent.

7. Process according to claim 6, characterized in that ascorbic acid is used as the reducing agent, in an amount of between 5 and 10 g/liter, in an acid medium.

8. Process according to claim 6, characterised in that hydrazine is used, in a basic medium, as the reducing agent.

9. Process for the manufacture of the textiles as defined in claim 1, in accordance with which the said textiles are subjected to the action of hydrogen sulphide under pressure, and then to the action of an aqueous solution of a copper salt, optionally in the presence of a swelling agent, characterised in that, after treatment with hydrogen sulphide under pressure, the subsequent treatment is carried out in the presence of at least one reducing agent.

10. Process according to claim 9, characterised in that the reducing agent is ascorbic acid, used in an acid medium at a pH which is between 1 and 5, and in an amount of between 1 and 20 g/liter.

11. Process according to claim 9, characterised in that the reducing agent is pyrogallol in an amount of at least 5 g/liter.

12. Process according to claim 6, characterised in that the copper salt is copper sulphate.

13. Textile articles with permanent conducting properties, characterised in that they contain between 0.01 and 5% of the treated textiles as defined in claim 1.

* * * * *